US009180986B2

(12) United States Patent
Takahashi

(10) Patent No.: US 9,180,986 B2
(45) Date of Patent: Nov. 10, 2015

(54) PACKAGING MACHINE

(71) Applicant: GENERAL PACKER CO., LTD., Aichi (JP)

(72) Inventor: Masaaki Takahashi, Alchi (JP)

(73) Assignee: GENERAL PACKER CO., LTD., Aichi (JP)

( * ) Notice: Subject to any disclaimer, the term of this patent is extended or adjusted under 35 U.S.C. 154(b) by 317 days.

(21) Appl. No.: 14/021,508

(22) Filed: Sep. 9, 2013

(65) Prior Publication Data

US 2014/0331619 A1 Nov. 13, 2014

(30) Foreign Application Priority Data

May 10, 2013 (JP) ..... 2013-100648

(51) Int. Cl.

| | |
|---|---|
| ***B65B 1/22*** | (2006.01) |
| ***B65B 43/16*** | (2006.01) |
| ***B65B 43/46*** | (2006.01) |
| ***B65B 51/14*** | (2006.01) |
| ***B65B 5/06*** | (2006.01) |

(52) U.S. Cl.

CPC . *B65B 1/22* (2013.01); *B65B 5/067* (2013.01); *B65B 43/16* (2013.01); *B65B 43/465* (2013.01); *B65B 51/146* (2013.01)

(58) Field of Classification Search

CPC ..... B65B 1/22; B65B 5/067; B65B 43/16; B65B 43/465

USPC ..... 141/10, 76–78, 166; 53/437, 459, 525

See application file for complete search history.

(56) References Cited

U.S. PATENT DOCUMENTS

| | | | | |
|---|---|---|---|---|
| 2,083,067 | A * | 6/1937 | James | B65B 7/08 53/370.3 |
| 2,755,007 | A * | 7/1956 | Knobel | B65B 1/46 141/147 |
| 3,676,977 | A * | 7/1972 | Rothmann | B65B 43/32 53/437 |
| 4,198,166 | A * | 4/1980 | Tuns | B65B 1/22 141/80 |
| 2013/0167487 | A1 * | 7/2013 | Dong | B65B 1/22 53/525 |

* cited by examiner

*Primary Examiner* — Timothy L Maust

(74) *Attorney, Agent, or Firm* — Cermak Nakajima & McGowan LLP; Tomoko Nakajima

(57) ABSTRACT

A packaging machine includes a shaping device including a conveyor drive mechanism and a bottom tapping mechanism and shaping a packaging bag filled with article so that the bag has a predetermined thickness. The conveyor drive mechanism includes a pair of side conveyors movable forward and backward. The conveyors are capable of pressing the bag filled with the article when moved forward. The conveyors are configured to be run in parallel to the moving direction of the bag substantially in synchronization with movement of the bag. The tapping mechanism includes a receiving plate disposed over the filling step and one or more steps following the filling step. The receiving plate is moved up and down so that the bag bottom is tapped, when the bag filled with the article is stopped between the filling step and one or more steps following the filling step.

3 Claims, 14 Drawing Sheets

PACKAGING MACHINE

CROSS-REFERENCE TO RELATED APPLICATIONS

This application is based upon and claims the benefit of priority from the prior Japanese Patent Application No. 2013-100648 filed on May 10, 2013, the entire contents of which are incorporated herein by reference.

BACKGROUND

1. Technical Field

The present disclosure relates to a packaging machine, and more particularly, to a packaging machine which automatically packages articles such as rice, sugar, salt, food for dogs or cats, or the like in packaging bags and shaping the packaging bags filled with the articles so that the packaging bags have respective thicknesses having a predetermined value.

2. Related Art

Japanese Patent Application Publication No. 2010-A-126244 discloses, as one type of the above-described packaging machine, a packaging machine which continuously produces products filled with articles by grasping an upper end of a packaging bag by grips and suspending the packaging bag, and intermittently moving to a zipper opening step, a filling step filling packaging bags with articles, a nitrogen gas filling step, a temporary sealing/deaeration/shaping step, a formal sealing step and a sealed part cooling step sequentially.

When a packaging bag filled with article differs in the thickness between an upper part thereof and a lower part thereof due to a bulging part at the bottom of the packaging bag or the like, collapsing of the packaging bags laid out flat tends to occur. In order that the packaging bag laid out flat may be prevented from collapsing, the packaging bags need to be shaped so that the packaging bags filled with articles have respective thicknesses having a predetermined value.

In the above-described conventional packaging machine, a bag opening is temporarily sealed in the temporary sealing/deaeration/shaping step so that an insertion hole for a deaeration nozzle is formed in the bag opening of the packaging bag. The packaging bag filled with the article is shaped by a shaping device so that the thickness of the packaging bag has the predetermined value, while the deaeration nozzle is inserted into the insertion hole to remove excessive air from the packaging bag.

The aforementioned shaping device includes a pair of inner and outer presser plates pressing the packaging bag from both sides of the bag, vibrators which are mounted on the respective presser plates to vibrate the respective presser plates and a receiving plate which is moved upward to receive and support the bottom of the packaging bag. In the temporary sealing/deaeration/shaping step, the receiving plate of the shaping device is moved upward to support the bottom of the packaging bag. With this, the pressing plates are simultaneously vibrated by the vibrator while the packaging bag is pressed by the pressing plates, whereby the article filling the packaging bag is vertically stretched so that the packaging bag is shaped so as to have a predetermined thickness.

In the above-described conventional packaging machine, the thickness of the packaging bag can be shaped into a predetermined value without variations when small-sized packaging bag has a capacity ranging from about 1 kg to 10 kg. However, when a large-sized bag having a capacity of 20 kg is used, for example, the conventional packaging machine requires substantial time to shape the packaging bag in order that the thickness thereof has a predetermined value without variations. Accordingly, even when the opening step, the nitrogen gas filling step and the like can be completed in a shorter time period, the production efficiency of the packaging machine would inevitably be reduced to a larger extent if the shaping step requires time.

SUMMARY

Therefore, an object of the present disclosure is to provide a packaging machine which can shape a large-sized packaging bag filled with article so that the packaging bag has a predetermined thickness substantially without variations and without reduction in the production efficiency.

The present disclosure provides a packaging machine which grasps an upper end of a packaging bag by a grip and suspends the packaging bag and thereafter, intermittently moves the packaging bag to a subsequent step. The machine comprises a shaping device including a conveyor drive mechanism and a bottom tapping mechanism. The shaping device shapes the packaging bag filled with the article so that the packaging bag has a predetermined thickness. In the machine, the conveyor drive mechanism includes a pair of inner and outer side conveyors movable forward and backward in a direction perpendicular to a direction in which the conveyor drive mechanism moves the packaging bag. The side conveyors are capable of pressing the packaging bag filled with the article, from both sides of the packaging bag, when moved forward. The side conveyors are disposed over the filling step and one or more steps following the filling step. The side conveyors are configured to be run in parallel to the moving direction of the packaging bag substantially in synchronization with movement of the packaging bag when the packaging bag is moved with movement of the grip. The bottom tapping mechanism includes a receiving plate which is movable up and down and is disposed over the filling step and one or more steps following the filling step. The receiving plate is moved up and down so that a bottom of the packaging bag is tapped, when the packaging bag filled with the article is stopped between the filling step and one or more steps following the filling step.

According to the above-described construction, the receiving plate is moved up and down to tap the bottom of the packaging bag while the bag filled with the article is pressed by the paired inner and outer side conveyors, whereby the article in the bag is vertically stretched with the result that the bag can be shaped so as to have a predetermined thickness.

The side conveyors and the receiving plate are disposed over the filling step and one or more steps following the filling step. The side conveyors are configured to be run in parallel to the moving direction of the packaging bag substantially in synchronization with movement of the packaging bag when the packaging bag is moved with movement of the grip. At the filling step, the receiving plate is moved up and down so that a bottom of the packaging bag is tapped, when the packaging bag filled with the article is stopped between the filling step and one or more steps following the filling step. Subsequently, the packaging bag is moved to a step following the filling step while being pressed by the side conveyors. The bottom of the packaging bag can be tapped by the bottom tapping mechanism again while the packaging bag is stopped.

Thus, the bottom of the packaging bag can be tapped while the packaging bag is pressed by the side conveyors over the filling step and one or more steps following the filling step. Consequently, a time period required for the shaping of the packaging bag can be increased without exerting an adverse effect on working hours of steps preceding and following the filling step. Accordingly, large-sized packaging bags each filled with the article can be shaped so as to have the predetermined thickness substantially without variations.

In one embodiment, the conveyor drive mechanism includes an inner side conveyor drive mechanism and an outer side conveyor mechanism. The inner side conveyor drive mechanism includes a base frame, an inner conveyor frame assembled to the base frame so that the inner conveyor frame is movable forward and backward in a direction perpendicular to the moving direction of the packaging bag, an inner conveyor frame driving motor which is fixed to the base frame to move the inner conveyor frame forward and backside in a direction perpendicular to a moving direction of the packaging bag, a pair of front and back inner rotating shafts rotatably assembled to the inner conveyor frame so that the inner side conveyor extends between the inner rotating shafts so as to be capable of running in a direction identical with the moving direction of the packaging bag, and an inner conveyor driving motor fixed to the inner conveyor frame to drive the inner rotating shafts thereby to run the inner side conveyor substantially in synchronization with movement of the packaging bag. The outer side conveyor drive mechanism includes a base frame, an outer conveyor frame which is assembled to the base frame so as to be movable forward and backward in a direction perpendicular to the moving direction of the packaging bag, an outer conveyor frame driving motor fixed to the base frame to move the outer conveyor frame forward and backward in the direction perpendicular to the moving direction of the packaging bag, a pair of front and back outer rotating shafts rotatably assembled to the outer conveyor frame so that the outer side conveyor extends between the outer rotating shafts so as to be capable of running in a direction identical with the moving direction of the packaging bag, and an outer conveyor driving motor fixed to the outer conveyor frame to drive the outer rotating shafts thereby to run the outer side conveyor substantially in synchronization with movement of the packaging bag.

In another embodiment, the bottom tapping mechanism includes an elevating frame assembled to the base frame so as to be movable up and down, the receiving plate being assembled to the elevating frame so as to be movable up and down, an elevating motor which is fixed to the base frame to move the elevating frame up and down, a receiving plate driving motor fixed to the elevating frame, and a link mechanism connecting between the receiving plate driving motor and the receiving plate to convert rotation of a drive shaft of the receiving plate driving motor to an upward/downward movement of the receiving plate.

DETAILED DESCRIPTION

Figure 1:
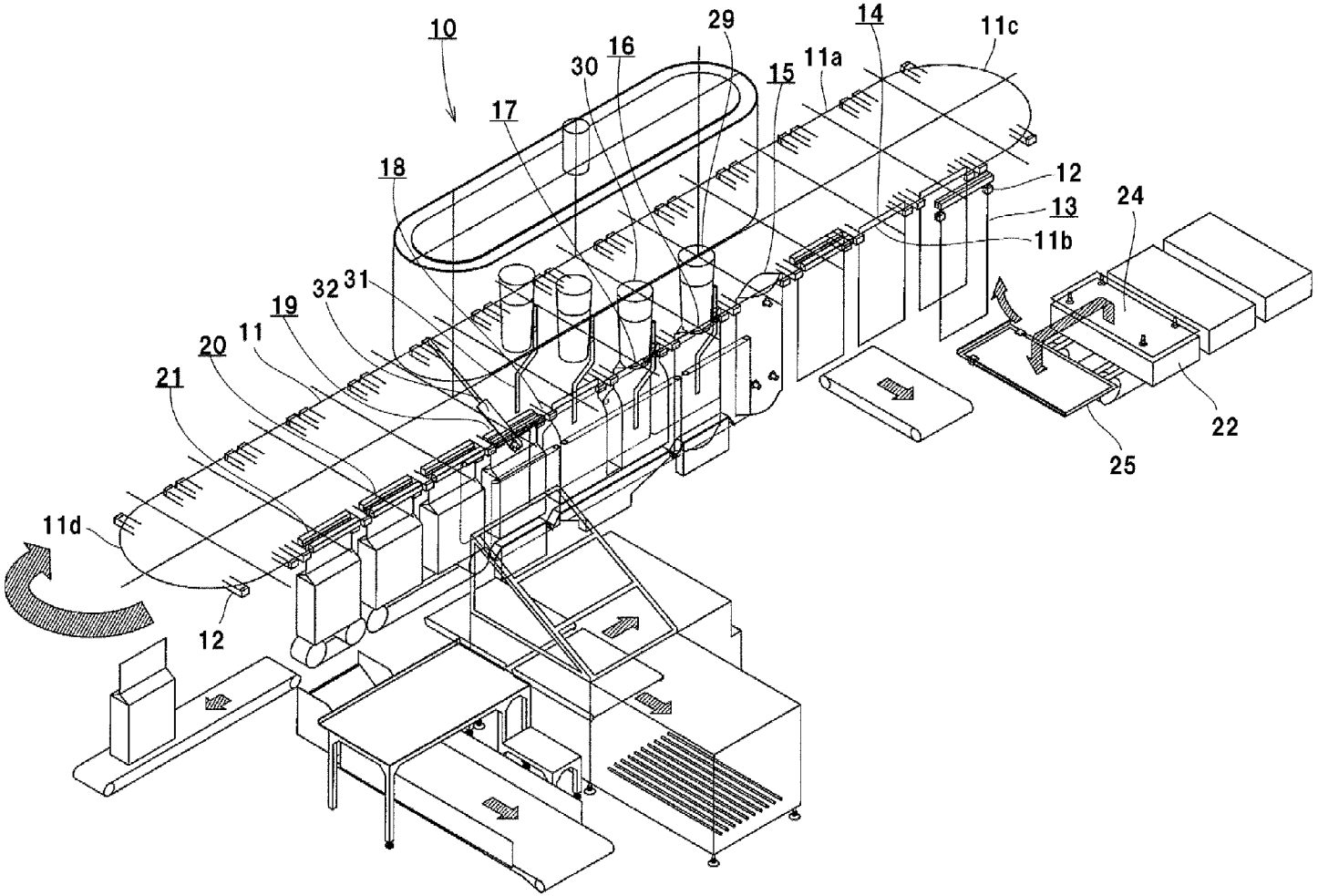
FIG. 1 is a schematic diagrammatic view of a packaging machine according to an embodiment, showing the entire construction of the packaging machine.

One embodiment will be described with reference to the accompanying drawings. Referring to FIG. 1, an overall construction of the packaging machine 10 according to the embodiment is schematically shown. The packaging machine 10 includes a plurality of grip pairs 12 which is intermittently moved along a work passage 11 constructed of a pair of inner and outer linear passages 11*a* and 11*b* and two semicircular passages connecting ends of the linear passages 11*a* and 11*b* together. Along the work passage 11 are provided a bag feeding step 13, an unzipping step 14, a bag opening/inflating step 15, a filling step 16, a shaping step 17, an deaeration nozzle opening step 18, a temporary sealing/deaeration step 19, a formal sealing step 20 and a seal cooling step 21 sequentially. The grip pairs 12 are stopped at every step and a predetermined work is applied to a packaging bag 24 suspended on the grip pair 12 while the grip pair is stopped.

Figure 2:
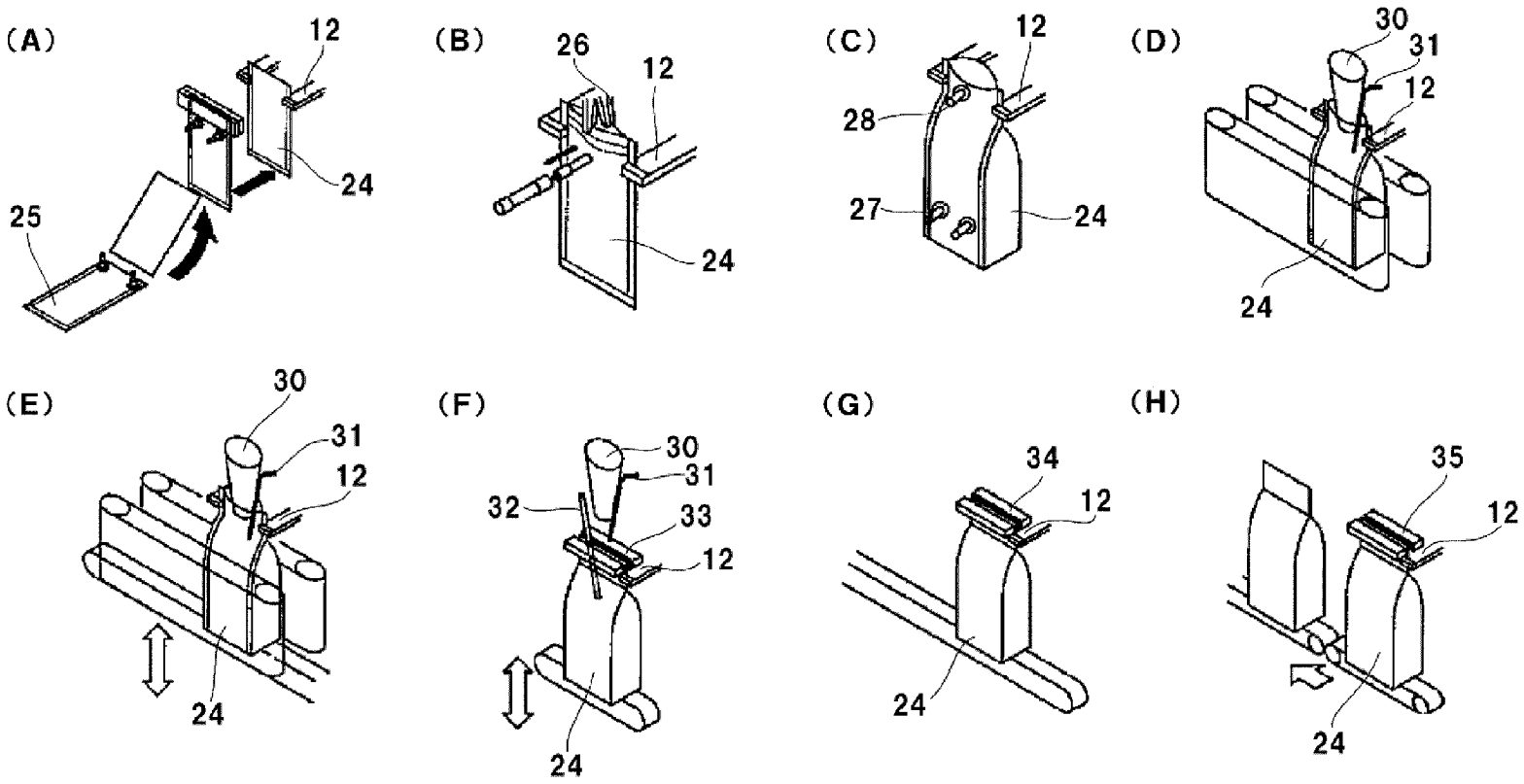
FIGS. 2A to 2H are illustrations explaining a sequence of steps executed by the packaging machine.

FIGS. 2A to 2H show work contents at respective steps. At the bag feeding step 13, packaging bags 24 stacked on a magazine 22 are adsorbed one by one by a suction disc to be once transferred to a positioning guide frame 25. The packaging bag 24 is placed on the guide frame 25, so that widthwise and lengthwise positions of the packaging bag 24 are corrected, as shown in FIG. 2A. An upper end of the packaging bag 24 is then grasped by the grip pair 12 so that the packaging bag 24 is suspended. Since the widthwise and lengthwise positions of the packaging bag 24 have been corrected by the guide frame 25, the grip pair 12 can grasp the upper end of the packaging bag 24 at a predetermined position.

In the unzipping step 14, a bag opening of the packaging bag 24 is unzipped by a claw 26 as shown in FIG. 2B. In the inflating step 15, the upper and lower ends of the packaging bag 24 are adsorbed by suction discs 27 and 28 respectively so that the packaging bag 24 is inflated, as shown in FIG. 2C.

A fixed funnel 29 is provided in the filling step 16 of the packaging machine 10. From the filling step 16 to the temporary sealing/deaeration step 19 are provided a movable funnel 30, a gas-filling nozzle 31, an inner side conveyor 57 and an outer side conveyor 62 both constituting a conveyor drive mechanism 40, a receiving plate 71 of a bottom tapping mechanism 70 and suction discs 118 and 119 constituting a movable auxiliary opening mechanism 90 as will be described in detail later.

The temporary sealing/deaeration step 19 is provided with a deaeration nozzle 32 and a temporary sealing device 33. The movable funnel 30 and the gas-filling nozzle 31 are constructed integrally with each other and are intermittently moved between the filling step 16 and the shaping step 17 substantially in synchronization with the packaging bag 24. The conveyor drive mechanism 40 and the bottom tapping mechanism 70 constitute a shaping device in the invention.

In the inflating step 15, the movable funnel 30 is inserted into the bag mouth of the packaging bag 24 suspended by the grip pair 12 as shown in FIG. 2D. In the filling step 16, the packaging bag 24 is filled with article supplied from the fixed funnel 29 via the movable funnel 30. A shaping work is simultaneously executed for the packaging bag 24 as will be described in detail later.

In the shaping step 17, the packaging bag 24 is filled with nitrogen gas supplied from a gas filling nozzle 31 as shown in FIG. 2E. The shaping work is simultaneously executed for the packaging bag 24.

As shown in FIG. 2F, in the deaeration nozzle opening step 18, an insertion hole for a deaeration nozzle 32 is formed in the bag mouth of the packaging bag 24 and in the temporary sealing/deaeration step 19, the packaging bag 24 is deaerated by the deaeration nozzle 32 so that remaining air is removed from the interior of the packaging bag 24 and thereafter, the bag mouth is temporarily sealed by a temporary sealing device 33, as will be described in detail later. The bag mouth is formally sealed by a sealing device in the formal sealing step 20, whereby the bag mouth is formed with a formal seal 34, as shown in FIG. 2G. A formally sealed part of the bag mouth is cooled by a cooling device 35 in the seal cooling step 21, as shown in FIG. 2H. The packaging bag 24 is subsequently discharged outside the packaging machine 10.

Figure 3:
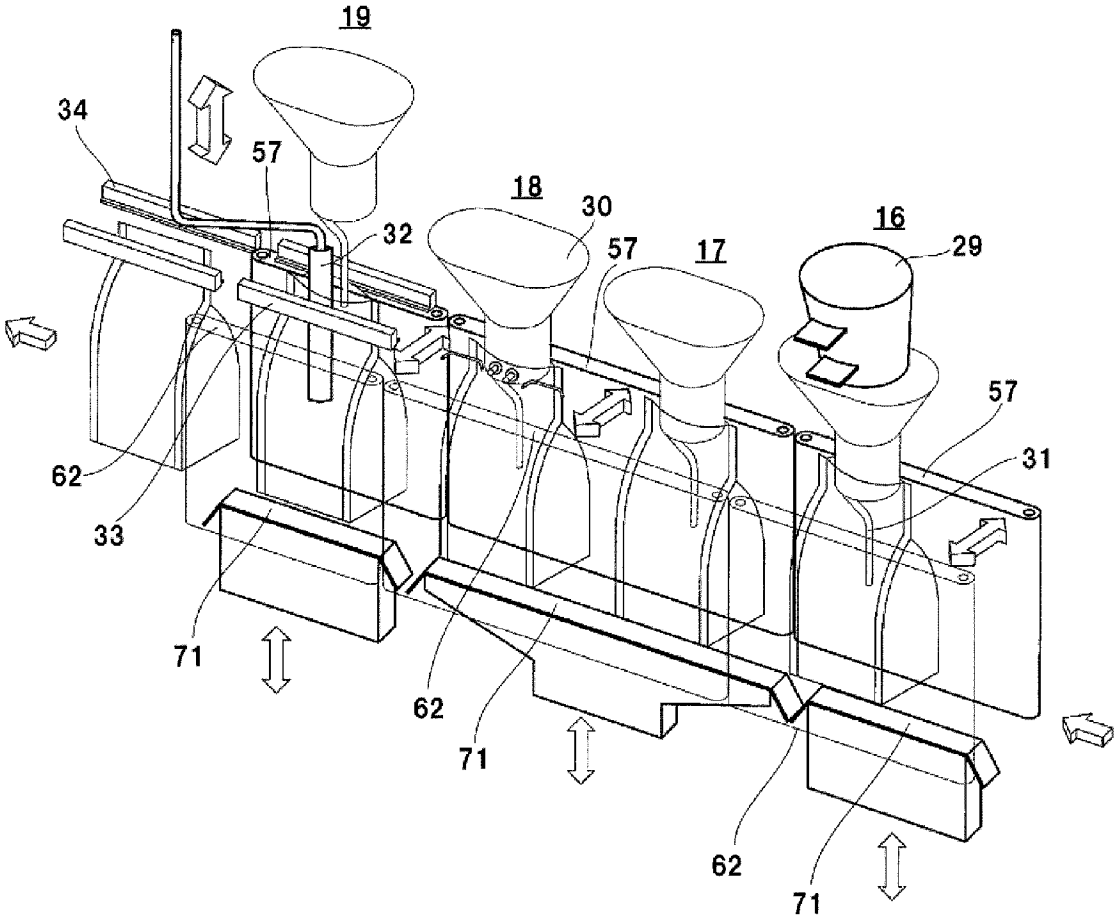
FIG. 3 is an illustration explaining a schematic construction from the filling step to the formal sealing step.

FIG. 3 schematically shows a construction from the filling step 16 to the formal sealing step 20. Inner and outer side conveyors 57 and 62 both constituting the conveyor drive mechanism 40 are disposed over the filling step 16 to the shaping step 17, the deaeration nozzle opening step 18 and the temporary sealing/deaeration step 19. A receiving plate 71 constituting the bottom tapping mechanism 70 is also disposed over the filling step 16 to the shaping step 17, the deaeration nozzle opening step 18 and the temporary sealing/deaeration step 19. The conveyor drive mechanism 40 and the bottom tapping mechanism 70 are disposed in the filling step 16, the shaping step 17 and the deaeration nozzle opening step 18 respectively. The bag mouth opening suction discs 101, 102 118 and 119 all constituting a movable auxiliary opening device 90 are also disposed in the deaeration nozzle opening step 18.

Figure 4:
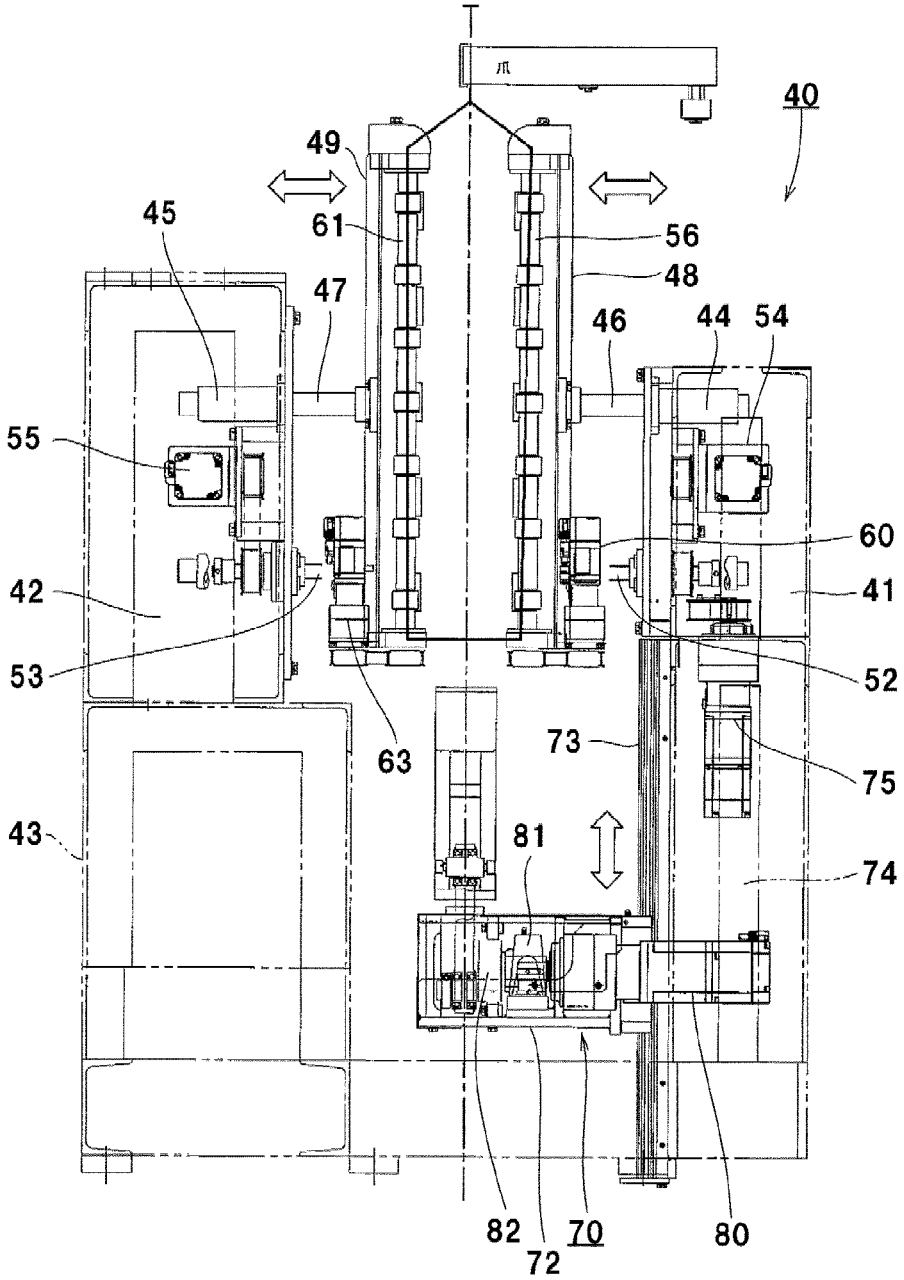
FIG. 4 is a schematic front view of a conveyor drive mechanism and a bottom tapping mechanism both constituting the shaping device of the packaging machine.
Figure 5:
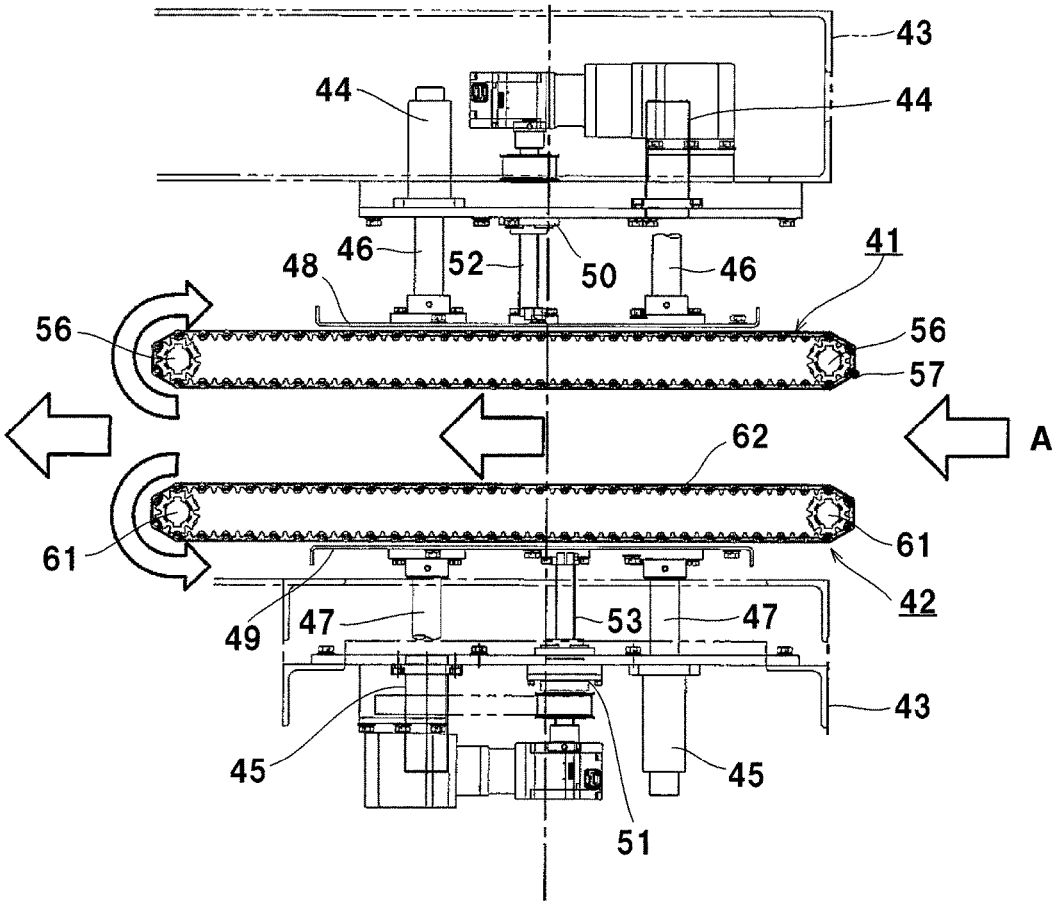
FIG. 5 is a plan view of the conveyor drive mechanism.

FIGS. 4 and 5 show the conveyor drive mechanism 40 in more detail. The conveyor drive mechanism 40 includes an inner side conveyor drive mechanism 41 and an outer side conveyor drive mechanism 42. The inner and outer conveyor drive mechanisms 41 and 42 are provided with a common base frame 43. An inner guide shaft 46 and an outer guide shaft 47 are assembled via respective bearings 44 and 45 to the base frame 43 so as to be movable forward and backward in a direction perpendicular to the linear passage 11*b* of the work passage 11, that is, a direction perpendicular to a moving direction A of the grip pair 12. The inner guide shaft 46 has a distal end to which an inner conveyor frame 48 is connected. The outer guide shaft 47 has a distal end to which an outer conveyor frame 49 is connected.

Two nut members 50 and 51 are rotatably mounted on the base frame 43. An inner ball screw 52 and an outer ball screw 53 are also mounted on the base frame 43 so as to be movable forward and backward. The inner and outer ball screws 52 and 53 have distal ends connected to the inner and outer conveyor frames 48 and 49 respectively.

An inner conveyor frame driving motor 54 and an outer conveyor frame driving motor 55 are fixed to the base frame 43. The inner conveyor frame driving motor 54 has a drive shaft drivingly coupled to the nut member 50 by a belt. The outer conveyor frame driving motor 55 also has a drive shaft drivingly coupled to the nut member 51 by a belt. When the inner conveyor frame driving motor 54 is driven for normal rotation, the inner nut member 50 is normally rotated, whereby the inner ball screw and the inner conveyor frame 48 formed integrally with the inner ball screw are moved forward. On the other hand, when the inner conveyor frame driving motor 54 is driven for reverse rotation, the inner conveyor frame 48 is moved backward.

When the outer conveyor frame driving motor 55 is driven for normal rotation, the nut member 51 is normally rotated, whereby the outer conveyor frame 49 is moved forward. On the other hand, when the outer conveyor frame driving motor 55 is driven for reverse rotation, the outer conveyor frame 49 is moved backward.

Figure 6:
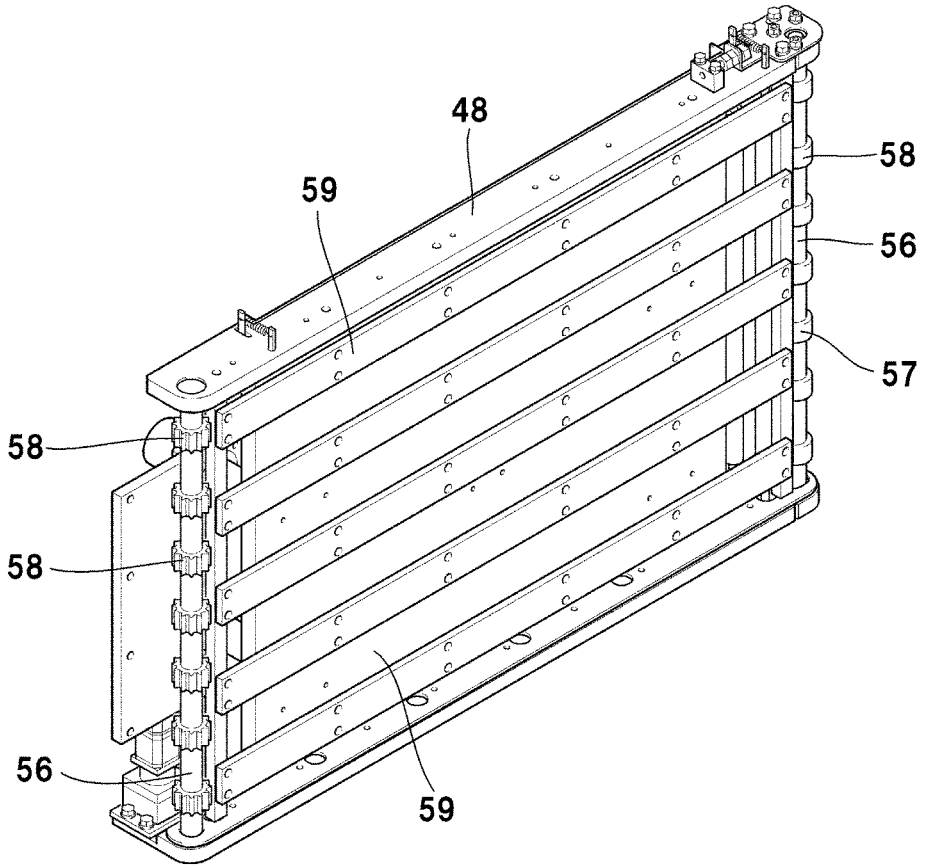
FIG. 6 is a perspective view of an inner conveyor frame of the conveyor drive mechanism.
Figure 7:
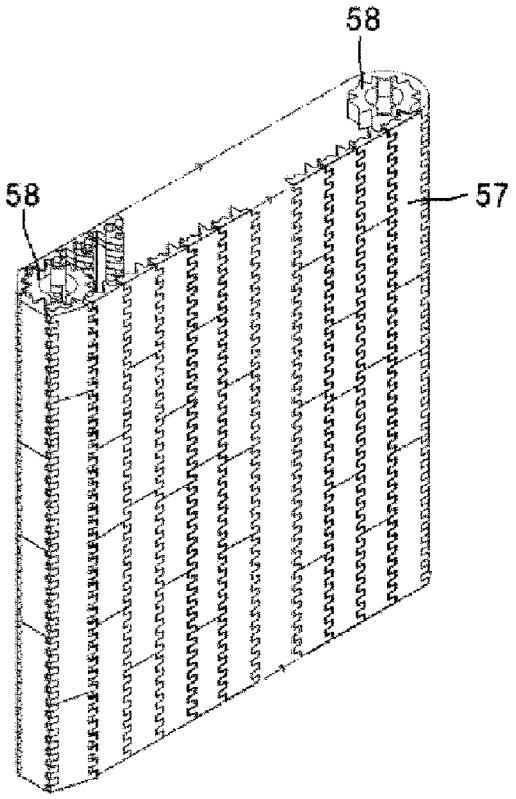
FIG. 7 is a perspective view of an inner side conveyor of the conveyor drive mechanism.

Two, namely, front and rear inner rotating shafts 56 are rotatably mounted on the inner conveyor frame 48. An inner side conveyor 57 extends between the inner rotating shafts 56. A plurality of sprockets 58 is secured to each inner rotating shaft 56 as shown as an enlarged view in FIG. 6. The sprockets 58 on each rotating shaft 56 are arranged in an up-down direction at regular intervals. A plurality of support plates 59 is provided between the inner rotating shafts 56. The support plates 59 are arranged in the up-down direction and have respective both ends fixed to the inner conveyor frame 48. The inner side conveyor 57 is constructed of a plastic chain conveyor and is engaged with the sprockets 58, as shown in detail in FIG. 7.

An inner conveyor driving motor 60 is fixed to the inner conveyor frame 48 and has a drive shaft connected to the inner rotating shaft 56. The inner rotating shaft 56 is rotated by the inner conveyor driving motor 60, so that the inner side conveyor 57 can be run in the same moving direction as packaging bag 24 substantially in synchronization with the movement of the packaging bag 24.

Two, namely, front and rear outer rotating shafts 61 are also rotatably mounted on the outer conveyor frame 49. An outer side conveyor 62 extends between the outer rotating shafts 61. A plurality of sprockets 58 is secured to each inner rotating shaft 61. A plastic chain conveyor constituting the outer side conveyor 62 is engaged with the sprockets 58.

An outer conveyor driving motor 63 is fixed to the outer conveyor frame 49 and has a drive shaft connected to the inner rotating shaft 56. The outer rotating shaft 61 is rotated by the outer conveyor driving motor 63, so that the outer side conveyor 62 is run in the same moving direction as packaging bag 24 substantially in synchronization with the movement of the packaging bag 24, in the same manner as the inner side conveyor 57.

Figure 8:
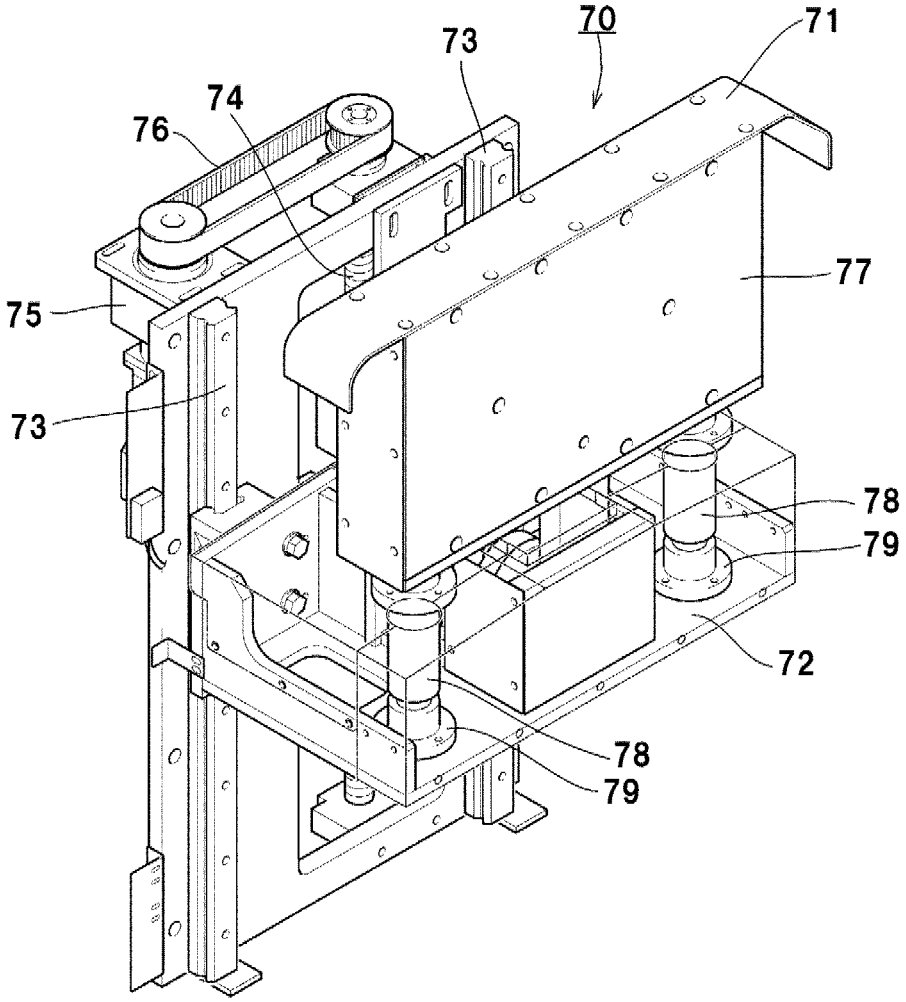
FIG. 8 is a perspective view of the bottom tapping mechanism.
Figure 9:
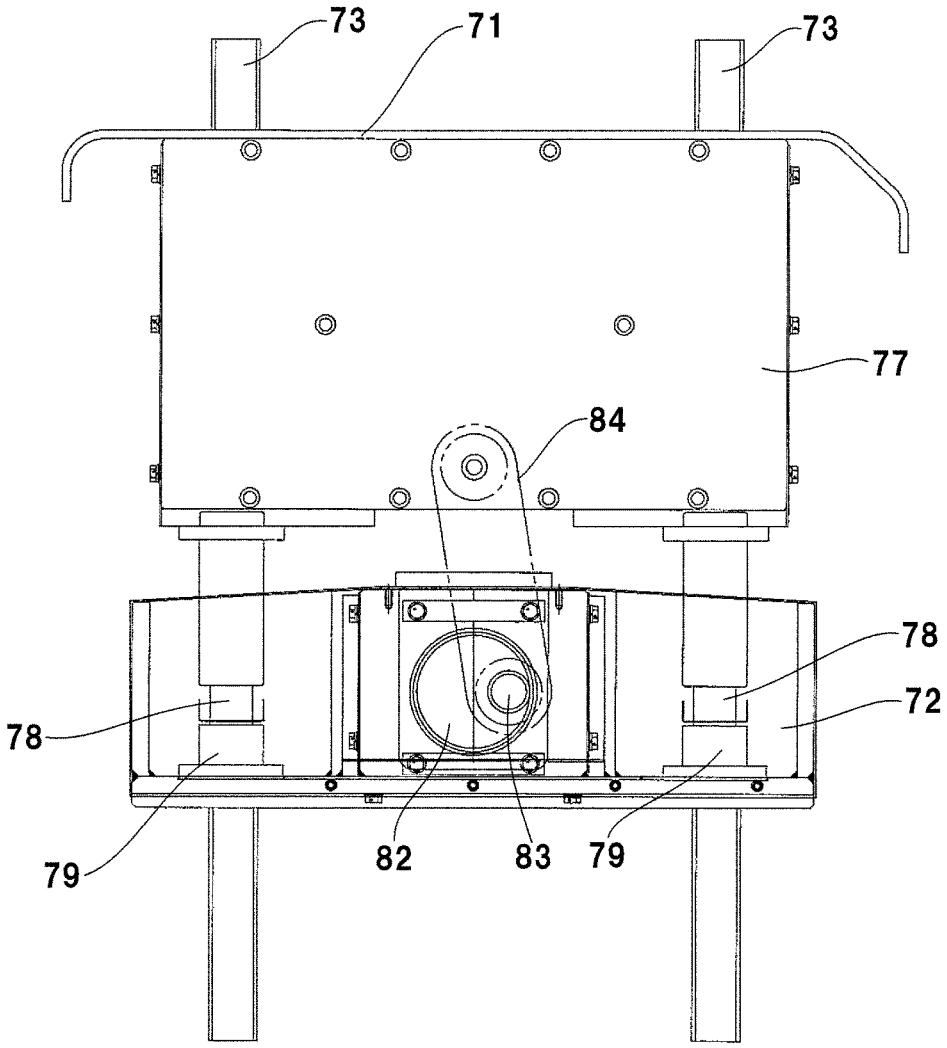
FIG. 9 is a side view of a major part of the bottom tapping mechanism.

FIGS. 4, 8 and 9 show a bottom tapping mechanism 70 in detail. The bottom tapping mechanism 70 includes an elevation frame 72 which is assembled to two guide rails 73 standing on the base frame 43 so as to be movable up and down. A ball screw 74 rotatably stands on the base frame 43 and an elevating motor 75 is fixed to the base frame 43. The ball screw 74 and a drive shaft of the elevating motor 75 are connected to each other by a belt 76. On the other hand, a nut member is fixed to the elevation frame 72 and in mesh engagement with the ball screw 74.

The receiving plate 71 is fixed to an upper end of a box type slide frame 77. Two guide shafts 78 droop from the slide frame 77 and are mounted on a bearing 79 provided on the elevation frame 72 so as to be slidable in the up-down direction. On the other hand, a receiving plate driving motor 80 is fixed to the elevation frame 72, and a circular cam disc 82 is rotatably mounted via a bearing 81 on the elevation frame 72.

The receiving plate driving motor 80 has a drive shaft connected to a rotating shaft of the cam disc 82. The cam disc 82 is provided with an eccentric shaft 83 which is connected to the slide frame 77 by a link lever 84. The cam disc 82, the eccentric shaft 83 and the link lever 84 constitute a link mechanism which converts rotation of the drive shaft of the receiving plate driving motor 80 to an up-and-down movement of the receiving plate 71.

In the bottom tapping mechanism 70 as described above, when the elevating motor 75 is driven, the ball screw 74 is rotated with the result that the elevation frame 72 is moved up and down. Furthermore, when the receiving plate driving motor 80 is driven, the cam disc 82 is rotated thereby to move the receiving plate 71 fixed to the slide frame 77 up and down along the guide shaft 73.

Figure 10:
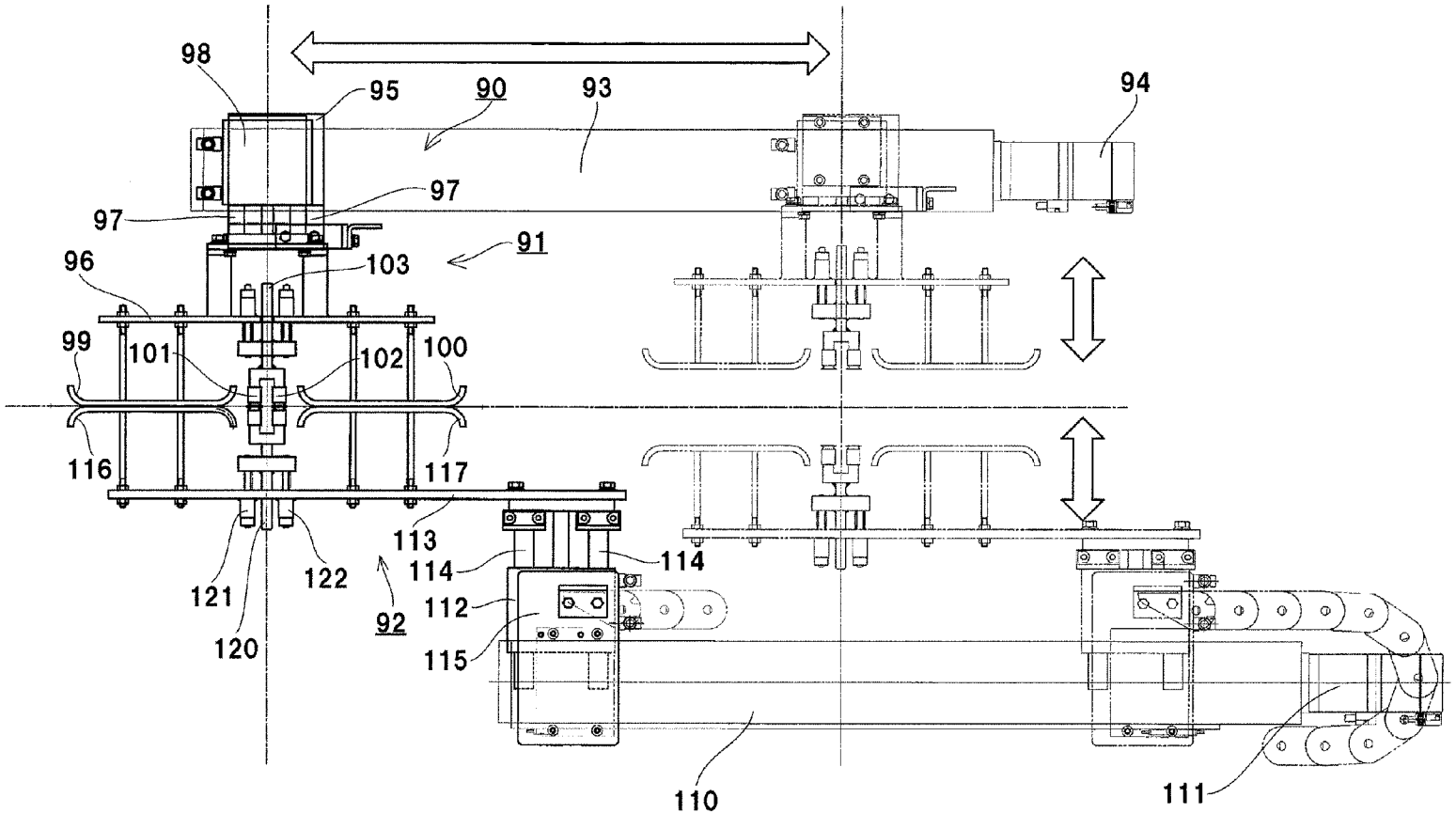
FIG. 10 is a plan view of a movable auxiliary opening device.
Figure 11:
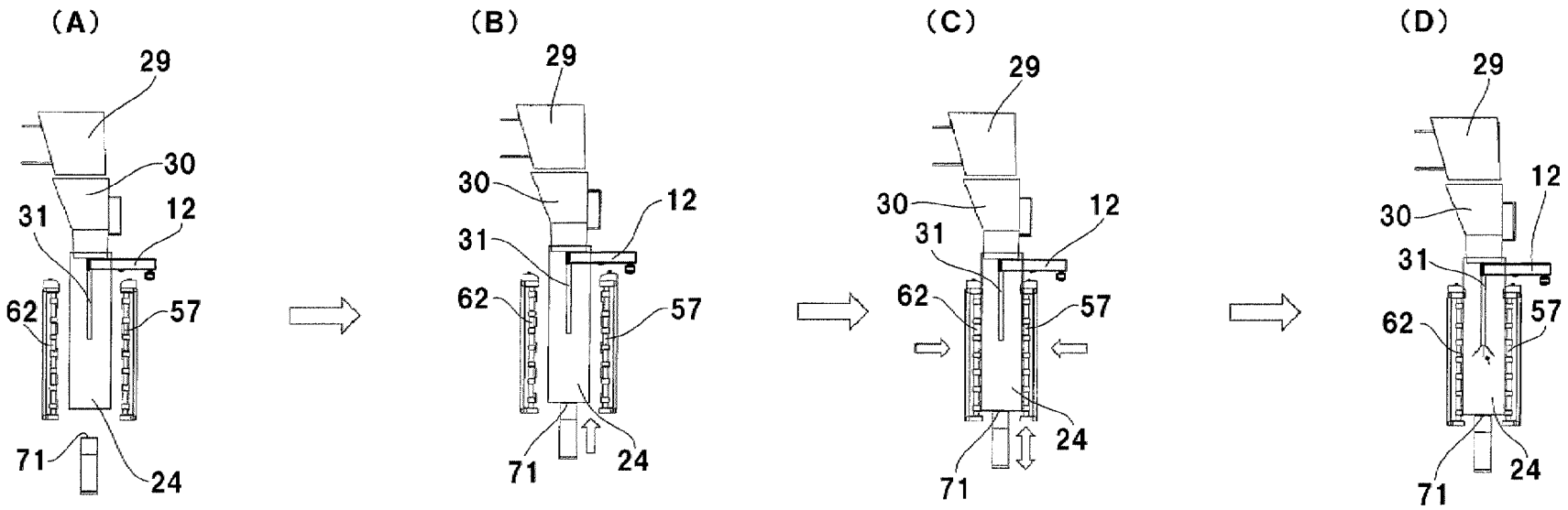
FIG. 11 is a schematic illustration explaining work contents in the filling step of the packaging machine.
Figure 12:
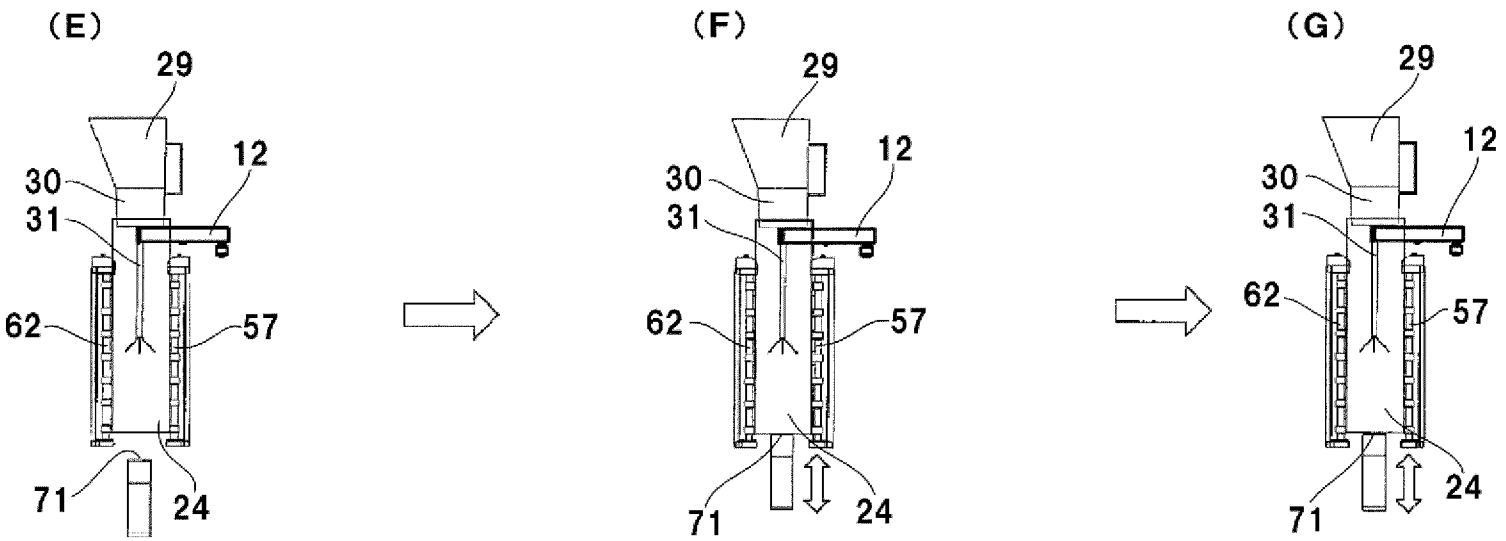
FIG. 12 is a schematic illustration explaining work contents in the shaping step of the packaging machine.
Figure 13:
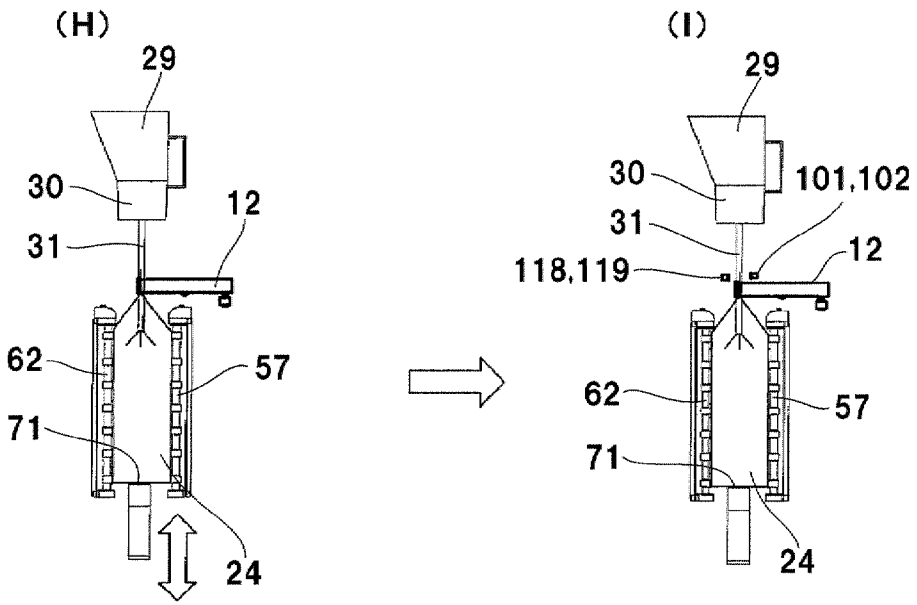
FIG. 13 is a schematic illustration explaining work contents in the deaeration nozzle opening step of the packaging machine.
Figure 14:
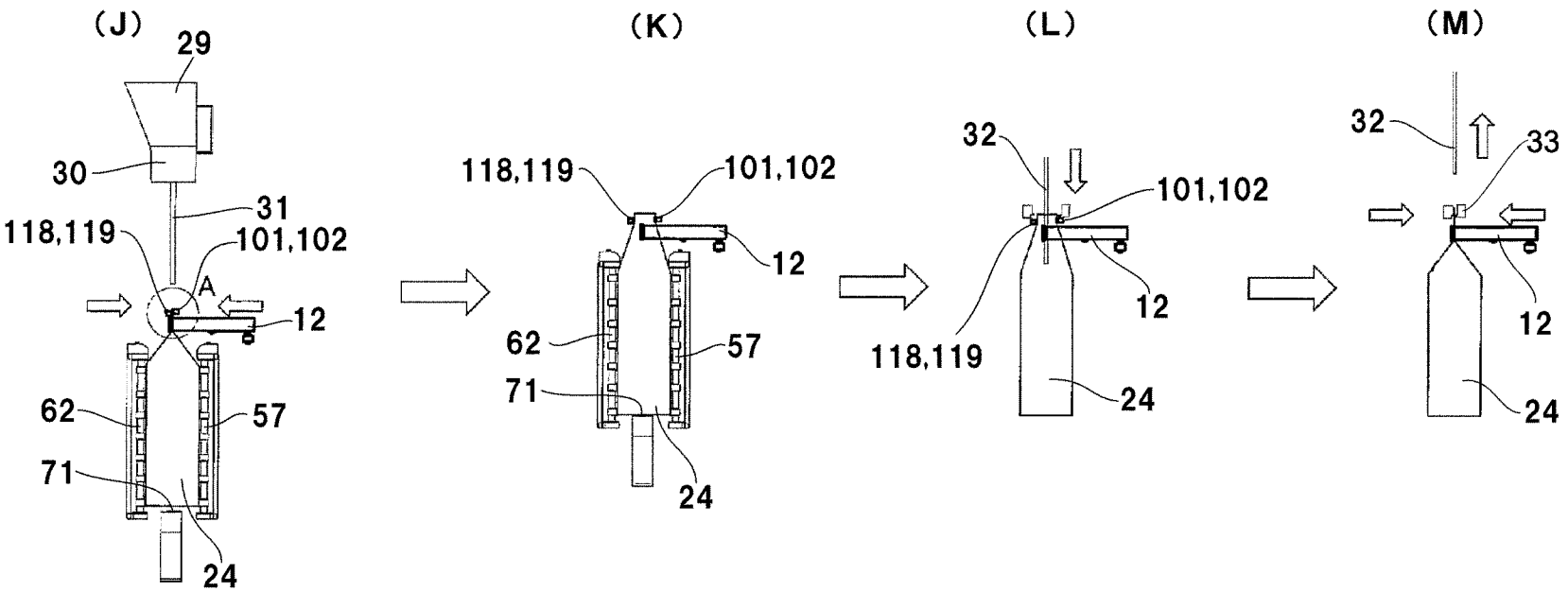
FIG. 14 is a schematic illustration explaining work contents in the temporary sealing/deaeration step of the packaging machine.

FIG. 10 shows the movable auxiliary opening mechanism 90. The auxiliary opening mechanism 90 includes an inner opening device 91 and an outer opening device 92. The inner opening device 91 includes an inner ball screw 93 rotatably mounted on the base frame 43 (not shown), an inner ball screw driving motor 94 fixed to the base frame 43 and an inner moving frame 95 to which a nut member is fixed. The inner ball screw 93 is rotatably in mesh engagement with the nut member. An inner slide plate 96 is mounted via a guide shaft 97 on the inner moving frame 95 so as to be movable forward and backward. An inner slide plate driving cylinder 98 is also fixed to the inner moving frame 95 and has a piston rod connected to the inner slide plate 96. A pair of inner bag mouth pressing guides 99 and 100 are fixed to the inner slide plate 96. A pair of inner bag mouth opening suction discs 101 and 102 are also fixed via a guide shaft 103 to the inner slide plate 96 so as to be movable forward and backward. The suction discs 101 and 102 are biased in a protruding direction by springs (not shown).

The outer opening device 93 also includes an outer ball screw 110 rotatably mounted on the base frame 43, an outer ball screw driving motor 111 fixed to the base frame 43 and an inner moving frame 115 to which a nut member is fixed. The outer ball screw 110 is rotatably in mesh engagement with the nut member. An outer slide plate 113 is mounted via a guide shaft 114 on the outer moving frame 115 so as to be movable forward and backward. An outer slide plate driving cylinder 112 is also fixed to the outer moving frame 115 and has a piston rod connected to the outer slide plate 113. A pair of outer bag mouth pressing guides 116 and 117 are fixed to the outer slide plate 113. A pair of outer bag mouth opening suction discs 118 and 119 are also fixed via a guide shaft 120 to the outer slide plate 113 so as to be movable forward and backward.

The front inner bag mouth pressing guide 99 of the inner opening device 91 is disposed so as to be opposed to the front outer bag mouth pressing guide 116 of the outer opening device 92 and vice versa. In the same manner, the rear inner bag mouth pressing guide 100 of the inner opening device 91 is disposed so as to be opposed to the rear outer bag mouth pressing guide 117 of the outer opening device 92 and vice versa. Furthermore, the front inner bag mouth opening suction disc 101 of the inner opening device 91 is disposed so as to be opposed to the front outer bag mouth opening suction disc 118 of the outer opening device 92 and vice versa. In the same manner, the rear inner bag mouth opening suction disc 102 of the inner opening device 91 is disposed so as to be opposed to the rear outer bag mouth opening suction disc 119 of the outer opening device 92 and vice versa.

In the auxiliary opening mechanism 90 thus constructed, the inner and outer ball screw driving motors 94 and 111 can move the inner and outer moving frames 95 and 112, the inner and outer bag mouth pressing guides 99, 100, 116 and 117 and the inner and outer bag mouth opening suction discs 101, 102, 118 and 119 in the same direction as the movement of the packaging bag 24 substantially in synchronization with the movement of the packaging bag 24.

Furthermore, the inner and outer slide plates 96 and 113 are moved forward by the inner and outer slide plate driving cylinders 98 and 115, whereby the bag mouth of the packaging bag 24 can be pressed by the inner and outer bag mouth pressing guides 99, 100, 116 and 117 thereby to be closed, respectively.

The inner and outer bag mouth opening suction discs 101, 102, 118 and 119 are moved forward by the inner and outer bag mouth opening suction disc cylinders 104, 105, 121 and 122, whereby the central bag mouth of the packaging bag 24 can be adsorbed by the inner and outer bag mouth opening suction discs 101, 102, 118 and 119. The inner and outer bag mouth opening suction discs 101, 102, 118 and 119 are moved backward by the inner and outer bag mouth opening suction disc cylinders 104, 105, 121 and 122, whereby the central bag mouth of the packaging bag 24 adsorbed by the inner and outer bag mouth opening suction discs 101, 102, 118 and 119 can be opened.

FIGS. 11A to 11D, 12E to 12G, 13H and 13I and 14J to 14M schematically show operations of the conveyor drive mechanism 40, the bottom tapping mechanism 70 and the movable auxiliary opening mechanism 90 in the filing step 16, the shaping step 17, the deaeration nozzle opening step 18 and the temporary sealing/deaeration step.

(A) The movable funnel 30 is moved above the bag mouth and stopped when the packaging bag 24 with the bag mouth opened at the inflating step arrives at the filling step to be stopped.

(B) The receiving plate 71 of the bottom tapping mechanism 70 is moved upward to support the bottom of the packaging bag 24, and the article is supplied from the fixed funnel 29 through the movable funnel 30 into the packaging bag 24.

(C) The inner and outer side conveyors 57 and 62 of the conveyor driving mechanism 40 are moved forward, whereby the packaging bag 24 is pressed from opposite sides. Simultaneously, the receiving plate 71 is repeatedly moved up and down so that the bottom of the packaging bag 24 is tapped, whereby the shaping work is executed for the packaging bag 24.

(D) A nitrogen gas is supplied from the gas filling nozzle 31 into the packaging bag 24.

(E) The packaging bag 24, the movable funnel 30 and the gas filling nozzle 31 are moved from the filling step 16 to the shaping step 17. In this case, the receiving plate 71 of the bottom tapping mechanism 70 equipped in the filling step 16 is moved downward to be departed from the bottom of the packaging bag 24.

(F) Both side conveyors 57 and 62 are run in the same direction as the packaging bag 24 substantially in synchronization with the movement of the packaging bag 24 while the packaging bag 24 is being pressed by the inner and outer side conveyors 57 and 62 of the conveyor drive mechanism 40. As a result, the packaging bag 24 is fed between the inner and outer conveyors 57 and 62 of the conveyor drive mechanism 40 equipped in the shaping step 17, thereby being pressed by the conveyors 57 and 62. In this while, the nitrogen gas is continuously fed from the gas filling nozzle 31 into the packaging bag 24.

(G) When the packaging bag 24 arrives at the shaping step 17 and is stopped, the receiving plate 7 of the bottom tapping mechanism 70 equipped in the shaping step 17 is moved up and down to tap the bottom of the packaging bag 24, thereby shaping the packaging bag 24. The nitrogen gas is continuously fed from the gas filling nozzle 31 into the packaging bag 24 during the movement from the gas filling step to the shaping step.

(H) The packaging bag 24 is moved from the shaping step 17 to the deaeration nozzle opening step 18. In this while, the packaging bag 24 is moved while being pressed by the inner and outer side conveyors 57 and 62. The packaging bag 24 is tapped by the receiving plate 71 during the movement, whereby the shaping work is continued. Furthermore, the movable funnel 30 and the gas filling nozzle 31 are moved upward from the bag mouth of the packaging bag 24.

(I) During movement of the packaging bag 24 from the shaping step 17 to the deaeration nozzle opening step 18, the inner and outer bag mouth opening suction discs 101, 102, 118 and 119 are moved inside and outside the bag mouth of the packaging bag 24 respectively.

(J) During movement of the packaging bag 24 from the shaping step 17 to the deaeration nozzle opening step 18, the movable funnel 30 and the gas filling nozzle 3 are departed from the bag mouth, and the bag mouth of the packaging bag 24 is pressed by the inner and outer bag mouth pressing guides 99, 100, 116 and 117 from the inside and the outside thereby to be closed. Furthermore, the central bag mouth of the packaging bag 24 is adsorbed by the inner and outer bag mouth opening suction discs 101, 102, 118 and 119 are adsorbed.

(K) During movement of the packaging bag 24 from the shaping step 17 to the deaeration nozzle opening step 18, the central bag mouth adsorbed by the inner and outer bag mouth opening suction discs 101, 102, 118 and 119 is opened.

(L) When the packaging bag 24 arrives at the temporary sealing/deaeration step 19, the deaeration nozzle 32 is inserted into the bag mouth. The remaining air in the packaging bag 24 is discharged by the deaeration nozzle 32. Furthermore, after insertion of the deaeration nozzle 32, the inner and outer bag mouth pressing guides 99, 100, 116 and 117 are returned to the deaeration nozzle opening step 18. The inner and outer bag mouth opening suction discs 101, 102, 118 and 119 are also returned to the deaeration nozzle opening step 119. In this while, the bottom of the packaging bag 24 is supported by the receiving plate 71 of the bottom tapping mechanism 70 equipped in the deaeration nozzle opening step 18 and the temporary sealing/deaeration step 19.

(M) The deaeration nozzle 32 is departed from the bag mouth after completion of deaeration, and the bag mouth is temporarily sealed by the temporary sealing device 33.

According to the above-described construction, the packaging bag 24 filled with the article can be tapped while being pressed by the inner and outer side conveyors 57 and 62 over the filling step 16, the shaping step 17 and the deaeration nozzle opening step 18. Accordingly, a time period required for the shaping of the packaging bag 24 can be increased without exerting an adverse effect on working hours of steps preceding and following the filling step 16. Accordingly, large-sized packaging bags 24 each filled with the article can be shaped so as to have a predetermined thickness without variations.

In the foregoing embodiment, the packaging machine has been described which includes the bag feeding step 13, the unzipping step 14, the bag opening/inflating step 15, the filling step 16, a shaping step 17, the deaeration nozzle opening step 18, the temporary sealing/deaeration step 19, the formal sealing step 20 and the seal cooling step 21 sequentially provided on the linear work passage 11. However, the embodiment may be applied to a rotary type packaging machine 10 including a circular work passage 11 and the work steps provided along the circular work passage 11.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A packaging machine which grasps an upper end of a packaging bag by a grip and suspends the packaging bag and thereafter, intermittently moves the packaging bag to a subsequent step, the machine comprising:

a shaping device including a conveyor drive mechanism and a bottom tapping mechanism, the shaping device shaping the packaging bag filled with the article so that the packaging bag has a predetermined thickness, wherein the conveyor drive mechanism includes a pair of inner and outer side conveyors movable forward and backward in a direction perpendicular to a direction in which the conveyor drive mechanism moves the packaging bag, the side conveyors being capable of pressing the packaging bag filled with the article, from both sides of the packaging bag, when moved forward, the side conveyors being disposed over a filling step and one or more steps following the filling step, the side conveyors being configured to be run in parallel to the moving direction of the packaging bag substantially in synchronization with movement of the packaging bag when the packaging bag is moved with movement of the grip;

wherein the bottom tapping mechanism includes a receiving plate which is movable up and down and is disposed over the filling step and one or more steps following the filling step; and wherein the receiving plate is moved up and down so that a bottom of the packaging bag is tapped, when the packaging bag filled with the article is stopped between the filling step and one or more steps following the filling step.

2. The machine according to claim 1, wherein the conveyor drive mechanism includes an inner side conveyor drive mechanism and an outer side conveyor mechanism;

wherein the inner side conveyor drive mechanism includes:

a base frame;

an inner conveyor frame assembled to the base frame so that the inner conveyor frame is movable forward and backward in a direction perpendicular to the moving direction of the packaging bag, an inner conveyor frame driving motor which is fixed to the base frame to move the inner conveyor frame forward and backward in a direction perpendicular to a moving direction of the packaging bag;

a pair of front and back inner rotating shafts rotatably assembled to the inner conveyor frame so that the inner side conveyor extends between the inner rotating shafts so as to be capable of running in a direction identical with the moving direction of the packaging bag; and an inner conveyor driving motor fixed to the inner conveyor frame to drive the inner rotating shafts thereby to run the inner side conveyor substantially in synchronization with movement of the packaging bag, and wherein the outer side conveyor drive mechanism includes:

a base frame;

an outer conveyor frame which is assembled to the base frame so as to be movable forward and backward in a direction perpendicular to the moving direction of the packaging bag;

an outer conveyor frame driving motor fixed to the base frame to move the outer conveyor frame forward and backward in the direction perpendicular to the moving direction of the packaging bag;

a pair of front and back outer rotating shafts rotatably assembled to the outer conveyor frame so that the outer side conveyor extends between the outer rotating shafts so as to be capable of running in a direction identical with the moving direction of the packaging bag; and an outer conveyor driving motor fixed to the outer conveyor frame to drive the outer rotating shafts thereby to run the outer side conveyor substantially in synchronization with movement of the packaging bag.

3. The machine according to claim 1, wherein the bottom tapping mechanism includes:

an elevating frame assembled to the base frame so as to be movable up and down, the receiving plate being assembled to the elevating frame so as to be movable up and down;

an elevating motor which is fixed to the base frame to move the elevating frame up and down;

a receiving plate driving motor fixed to the elevating frame; and a link mechanism connecting between the receiving plate driving motor and the receiving plate to convert rotation of a drive shaft of the receiving plate driving motor to an upward/downward movement of the receiving plate.

* * * * *